US006524175B2

(12) United States Patent
Beaudry et al.

(10) Patent No.: US 6,524,175 B2
(45) Date of Patent: Feb. 25, 2003

(54) SANDING SPONGE

(76) Inventors: Donald W. Beaudry, P.O. Box 49485, Blaine, MN (US) 55449-0485; Leonard Launderville, Jr., 9458 Able St. NE, Blaine, MN (US) 55434

( * ) Notice: Subject to any disclaimer, the term of this patent is extended or adjusted under 35 U.S.C. 154(b) by 115 days.

(21) Appl. No.: 09/727,519

(22) Filed: Dec. 4, 2000

(65) Prior Publication Data

US 2001/0000503 A1 Apr. 26, 2001

Related U.S. Application Data

(63) Continuation-in-part of application No. 09/159,229, filed on Sep. 23, 1998, now Pat. No. 6,227,959, which is a continuation-in-part of application No. 09/028,918, filed on Feb. 24, 1998, now abandoned.

(60) Provisional application No. 60/049,769, filed on Jun. 16, 1997.

(51) Int. Cl.[7] ..... B24D 11/00

(52) U.S. Cl. ..... 451/524; 451/523; 451/526

(58) Field of Search ..... 451/354, 523, 451/524, 525, 507, 490, 522

(56) References Cited

U.S. PATENT DOCUMENTS

| | | | | |
|---|---|---|---|---|
| 2,523,884 | A | 9/1950 | Swenson | |
| 2,817,931 | A | 12/1957 | Houser | |
| 3,279,130 | A | 10/1966 | Nelson | |
| 3,998,012 | A | 12/1976 | Demers | |
| 4,182,000 | A | 1/1980 | Fairbairn | |
| 4,202,139 | A | 5/1980 | Hong et al. | |
| 4,391,013 | A | 7/1983 | Janssen | |
| 4,399,170 | A | 8/1983 | Janssen | |
| 4,774,789 | A | 10/1988 | Amalfi | |
| 4,802,310 | A | 2/1989 | Holmes | |
| 4,825,597 | A | 5/1989 | Matechuk | |
| 4,829,719 | A | 5/1989 | Braselton | |
| 4,885,876 | A | 12/1989 | Henke | |
| 5,016,402 | A | 5/1991 | Reiter | |
| 5,036,627 | A | 8/1991 | Walters | |
| 5,054,248 | A | 10/1991 | Thayer | |
| 5,123,139 | A | 6/1992 | Leppert et al. | |
| 5,131,193 | A | 7/1992 | Demers | |
| 5,168,672 | A | 12/1992 | Gregoire, Sr. | |
| 5,220,752 | A | 6/1993 | Cheney et al. | |
| 5,245,797 | A | 9/1993 | Milkie | |
| 5,309,681 | A | 5/1994 | Cheney et al. | |
| 5,474,490 | A | 12/1995 | Allport | |
| 5,479,675 | A | 1/1996 | Pytlewski | |
| 5,522,763 | A | 6/1996 | Regnier | |
| 5,605,500 | A | 2/1997 | Matechuk | |
| 5,624,305 | A | 4/1997 | Brown | |
| 5,651,728 | A | 7/1997 | Stanzione | |
| 6,227,959 | B1 * | 5/2001 | Beaudry | 451/526 |

FOREIGN PATENT DOCUMENTS

| | | |
|---|---|---|
| CH | 345435 | 5/1960 |
| EP | 315287 | 5/1989 |
| GB | 2065512 | 7/1981 |
| GB | 2244945 | 12/1991 |

* cited by examiner

*Primary Examiner*—Timothy V. Eley

(57) ABSTRACT

The sanding sponge primarily is used for sanding finished dry wall. The sanding sponge is made from a cellular foam material in the shape of a right prism in which the bases have the shape of an isosceles trapezoid. The sanding sponge has an abrasive coating on the bottom surface and the two lateral surfaces, and a layer of hook and loop fastening material adhesively attached to the top surface. The sanding sponge is part of a kit including a hand sander base and a pole sander head. The hand sander base has a plate with a handle on the top surface and a layer of hook and loop fastening material on the bottom surface for removably attaching the sanding sponge. The pole sander head has a plate with a universal joint attached to the top surface and a layer of hook and loop fastening material on the bottom surface.

16 Claims, 5 Drawing Sheets

SANDING SPONGE

CROSS-REFERENCE TO RELATED APPLICATIONS

This is a continuation-in-part of a prior application Ser. No. 09/159,229, filed Sep. 23, 1998, now U.S. Pat. No. 6,227,959 which is a continuation-in-part of application Ser. No. 09/028,918, filed Feb. 24, 1998, which now is abandoned claiming the benefit of U.S. Provisional Patent Application Ser. No. 60/049,769, filed Jun. 16, 1997.

BACKGROUND OF THE INVENTION

1. Field of the Invention

The present invention relates to tools for sanding a surface and, more specifically, to a sanding sponge constructed of a cellular foam material. The application further relates to a sanding sponge kit which includes a sanding sponge, a hand sander base, and a pole sander head, the sponge being removably attachable to either the hand sander or the pole sander.

2. Description of Related Art

Abrasive sanding tools are used in a wide variety of applications which require smoothing, cleaning, feathering, or otherwise finishing a surface. Some applications, such as sanding corners and angles of finished dry wall, require hand sanding where a user will grasp a coated abrasive sheet in their hand and apply it directly to the surface being treated. This process is often ineffective because irregular pressure, such as caused by finger. against the back side of the abrasive sheet in use, produces an irregular abraded surface, or because the surface to be treated is difficult or impossible to reach directly by hand.

In order to overcome this inefficiency, several tools which assist in the holding of an abrasive surface have been disclosed it the related art. These have included hand-held foam blocks having abrasive surfaces permanently or removably attached thereto and handle attached rigid blocks having an abrasive surface fixedly or removably attached thereto.

U.S. Pat. No. 5,054,248, issued Oct. 8, 1991 to Donald R. Thayer, discloses a hand-held sanding sponge molded from flexible cellular foam into a block having an easily gripped handle on its top surface and an abrasive layer removably attached to its bottom surface. One edge of the bottom surface is acutely angle while the opposed edge is curved to allow the sanding sponge to be used on a variety of surfaces including corners and curves surfaces.

U.S. Pat. No. 5,131,193, issued Jul. 21, 1992 to Michael J. Demers, discloses a hand-held sanding tool adapted for abrading a surface having a specific contour. The tool has an upper portion forming an easily gripped handle and a lower portion having an abrasive surface with a predetermined profiled contour matching the configuration of a grooved wall on an automobile part.

U.S. Pat. No. 3,998,012, issued Dec. 21, 1976 to Reuben Ness, discloses a sanding sponge in the form of a cellular plastic cylinder having a layer of abrasive material removably secured to its bottom end with an adhesive substance. The bottom end of the sanding sponge may have a variety of curved or angled contours and the top end of the sponge may have a layer of fibrous material adhered thereto to act as a cushion for the users hand and to be used to remove dust from the surface being treated.

U.S. Pat. No. 4,202,139, issued May 13, 1980 to In S. Hong and Glen E. Roelofs, discloses a hand-held sanding tool comprising a pad having a bottom surface adapted to have an adhesive coated abrasive sheet attached thereto and a top surface having a handle adapted to be wrapped around one or more of a users fingers to hold the pad in place on the users hand. The sanding tool of Hong et al. is intended to minimize the user's discomfort while sanding.

U.S. Pat. No. 4,825,597, issued May 2, 1989 to William Matechuk, discloses a handle mounted sanding tool adapted for sanding corner joints in dry wall construction. The tool has a resilient foam block which has two abrasive faces adapted to fit the contour of a corner and which is mounted on a pole-attached carrier that properly distributes the force exerted on the handle to the faces of the foam block.

U.S. Pat. No. 2,817,931, issued Dec. 31, 1957 to Burdette C. Houser, and U.S. Pat. No. 3,279,130, issued Oct. 18, 1966 to Arthur E. Nelson, also disclose handle mounted sanding tools adapted for sanding corner joints. Both tools have carriers with two faces joined at an angle that are adapted to have sandpaper wrapped therearound and secured in place.

U.S. Pat. No. 4,774,789, issued Oct. 4, 1988 to Jerome L. Amalfi, discloses a hand-held sanding tool adapted for sanding an external corner. The sanding tool of Amalfi has two opposed plates with abrasive surfaces joined at a right angle which are reciprocated by a motor in the small handle extending rearwardly from the opposed plates.

U.S. Pat. No. 4,885,876, issued Dec. 12, 1989 to David R. Henke, discloses a sanding tool for sanding a flat surface which has a hand grip which is interchangeable with a pole grip, The tool is adapted to have sandpaper wrapped around a base member and secured in place by attaching one of the grips to the top of the base member.

U.S. Pat. No. 2,523,884 issued Sep. 26, 1950 to H. R. Swenson discloses a sander-scraper combination having a sander block having a rectangular shape. Swiss Patent 345,435 published May, 1960 discloses a sanding block mounted to a pole sander, the block being rectangular with radially shaped ends. United Kingdom Patent Number 2,065,512 issued Jul. 1, 1981, discloses a hand tool with a handle and a blade, the blade being essentially a sanding block having sand paper wrapped around both faces and retained by clips, but no pad, the blade having a variety of shapes including rectangular and wedge shapes.

European Patent Number 315,287 published May 10,1989 discloses a hand sander including a plate or block having four symmetrically arranged holes, the sand paper extending through the holes and being clamped by tongues. United Kingdom Patent Number 2,244,945 issued Dec. 18, 1991 discloses a hand held sanding block having a flexible band of sand paper fitting snugly around the circumference of the block.

Additional patents showing sanding tools include U.S. Pat. Nos. 4,391,013 and 4,399,170 (wet sander for wallboard finishing work and method of using same); U.S. Pat. No. 5,522,763 (sanding block with a kerf for securing sandpaper); U.S. Pat. No. 5,168,672 (sanding block using wedge pressure from handle member to clamp sand paper); U.S. Pat. No. 5,220,752 (sanding device with flexible straps for attachment to hand or power sander); U.S. Pat. No. 5,474,490 (sanding block with elastic members retracting 1 holding elements to retain sandpaper); and U.S. Pat. No. 5, 651,728 (ergonomic sanding block with thumb fossa and finger filisters).

Further sanding devices are described in U.S. Pat. No. 5,036,627 (sanding device using a vacuum to remove dust); U.S. Pat. No. 5,123,139 (foam buffing pad for use with a power tool); U.S. Pat. No. 5, 624,305 (pole mounted vacuum sander); U.S. Pat. No. 5,605,5000 (vacuum attachment for a sander); U.S. Pat. No. 5,479,675 (trowel with handle secured to blade by tongue and groove joint); U.S. Pat. No. 5,309,681 (sanding pad for attachment to power sander); U.S. Pat. No. 5,245,797 (manual sander using sandpaper); U.S. Pat. No. 5,016,402 (sanding device with handle removably attached to base); U.S. Pat. No. 4,829,719 (sanding pad retained on a pole by hook and loop fastening material, but does not teach resilient pad) ; U.S. Pat. No. 4,802,310 (sandinc attachment for an oscillating sander); and U.S. Pat. No. 4,182,000 (scraper attachment for a power sander).

None of the above inventions and patents, taken either single or in combination, is seen to describe the instant invention as claimed.

SUMMARY OF THE INVENTION

The present invention is a sanding sponge primarily intended to be used for sanding angles and corners of finished dry wall The sanding sponge is a body formed from a resilient foam material having an abrasive disposed on its bottom and side surfaces. The sanding sponge has a distinctive shape, the resilient foam body being formed in the shape of a right prism whose bases are isosceles trapezoids so that the opposed lateral faces and the bottom surface of the sanding sponge are joined at an acute angle This configuration is ideal for sanding the corners and angles of finished drywall, as it permits sanding of one wall forming the corner without abrading the orthogonal wall.

The sanding sponge is adapted to be removably attached to a commercially available pole sander. A hook and loop type fastening material, such as "Velcro", is adhesively bonded to the top surface of the bottom portion of the sanding sponge, and a mating hook and loop type fastening material is attached to the end of the pole sander.

The sanding sponge may be included as part of a kit which also includes a hand sander base and a pole sander head. The sponge is a resilient foam sanding sponge having the shape of a right prism, a cross section of the sponge having the shape of an isosceles trapezoid. The top surface of the sponge has a layer of hook and loop fastening material adhesively attached thereto. The bottom and lateral side surfaces have an abrasive coating, the end surfaces being free of abrasive material. The hand sander base includes a handle, preferably in the form of a C-shaped hand grip, attached to a flat, elongated, rectangular metal plate having a layer of hook and loop material adhesively fastened to its bottom surface for releasable attachment to the sanding sponge. The pole sander head is a flat, elongated, rectangular metal plate having a universal joint pivotally attached to its top surface and a layer of hook and loop fastening material adhesively attached to its bottom surface for releasable attachment to the sanding sponge. The sanding sponge may be used with the hand grip for drywall areas within arms reach, and then removed from the hand sander base and attached to the pole sander head for reaching drywall areas which are beyond arm's length.

Accordingly, it is a principal object of the invention to provide a sanding tool having acutely angled opposed edges on its bottom surface to maximize its efficiency when used for sanding corners and angles of dry wall.

It is another object of the invention to provide a sanding sponge which may be releasably attached to either a hand sander base or a pole sander head.

It is a further object of the invention to provide a sanding sponge kit with a hand sander base and a pole sander head, the sponge being releasably attached to the hand sander base or the pole sander head quickly and easily through the use of hook and loop fastening material.

Still another object of the invention is to provide a sanding sponge kit which may be used for sanding open expanses of drywall as well as finishing drywall corners either by directly by hand or using an extension pole.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
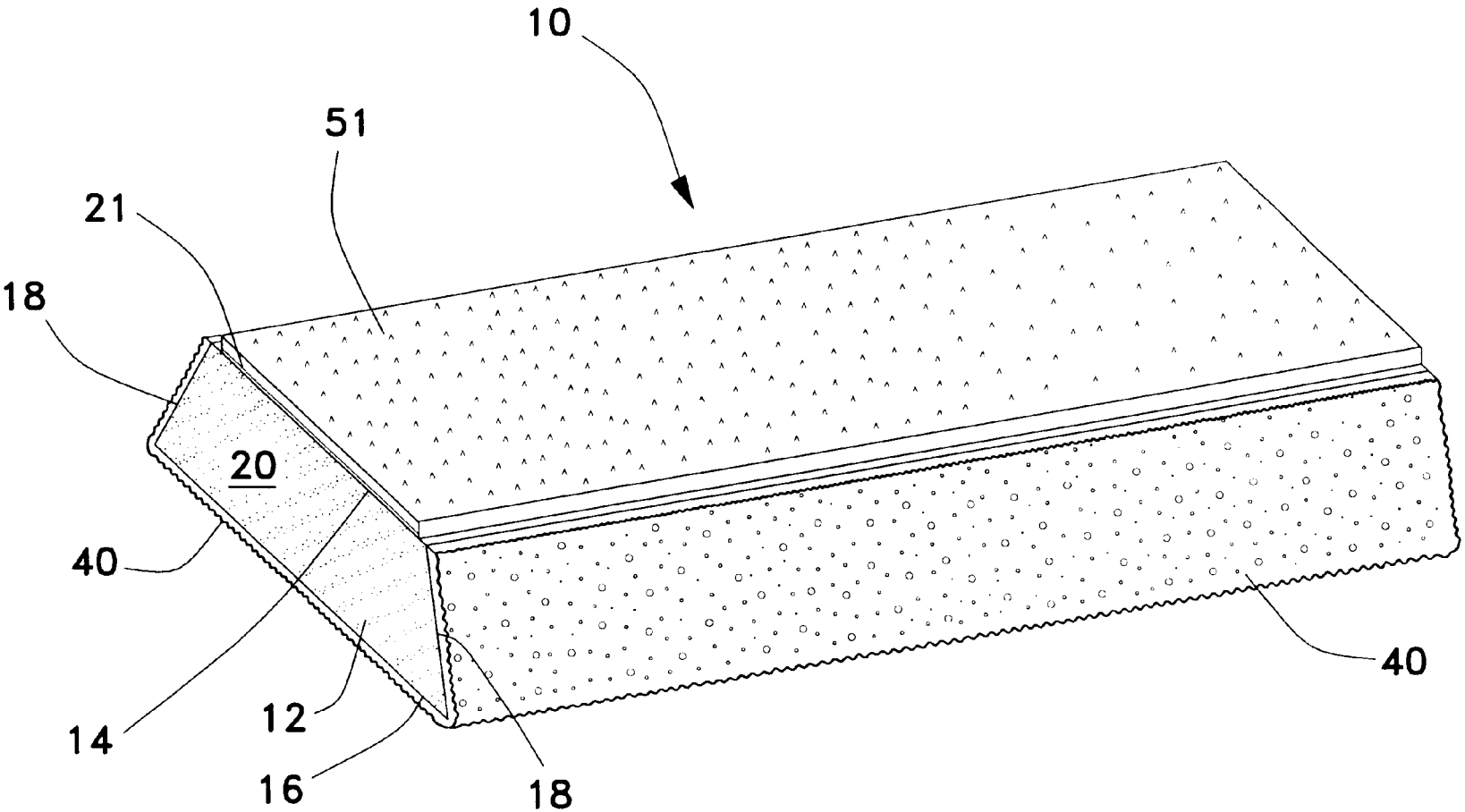
FIG. 1 is a perspective view of a sanding sponge according to the present invention.

Referring to the drawings, FIG. 1 illustrates the sanding sponge 10 of the present invention intended to be used for sanding angles and corners of finished dry wall. The sanding sponge 10 has a body 12 formed from a cellular foam material and having the shape of a right prism, including a top surface 14, a bottom surface 16, opposing lateral surfaces 18, and opposing end surfaces 20 (only one shown in FIG. 1, the other opposing end surface being symmetrical). The sanding sponge has an abrasive layer 40 fixedly attached to or formed integrally on the bottom surface 16 and side surfaces 18 of the sanding sponge 10. The end surfaces 20 are not covered with an abrasive coating. Preferably the abrasive is either 80 or 120 grit for medium or fine sanding, respectively. In alternate embodiments, the side surfaces 18 may remain free of the abrasive layer 40, but it has been found that the abrasive layer 40 will wear less rapidly under normal use conditions when adhered to the side surfaces 18 as well as the bottom surface 16 as a continuous layer of material. The abrasive layer 40 may be applied as a sheet of abrasive material with a rubber or film backing wrapped around the lateral surfaces 18 and bottom surface 16 and secured to the foam body 12 by adhesive.

While the lateral surfaces 18 may join the bottom surface 16 at any acute angle, it has been found in practice that joining the lateral surfaces 18 and the bottom surface 16 at an angle of approximately 45° gives the bottom portion 16 of the sanding sponge 10 properties ideal for sanding angles and corners of dry wall. However, it will be understood that the scope of the present invention extends to any sanding sponge in which the bottom surface 16 is joined to the two lateral surfaces 18 at any angle between 35° and 70°.

A strip or layer of hook and loop type fastening material 51, such as that sold under the trade designation "Velcro", is adhesively bonded to the top surface 14 of the sanding sponge 10 by a suitable adhesive 21. A corresponding and mating strip of the fastening material (not shown) adapted to fit the head of any standard size pole sander may be packaged with the sanding sponge for attachment to the end of the pole sander.

Figure 2:
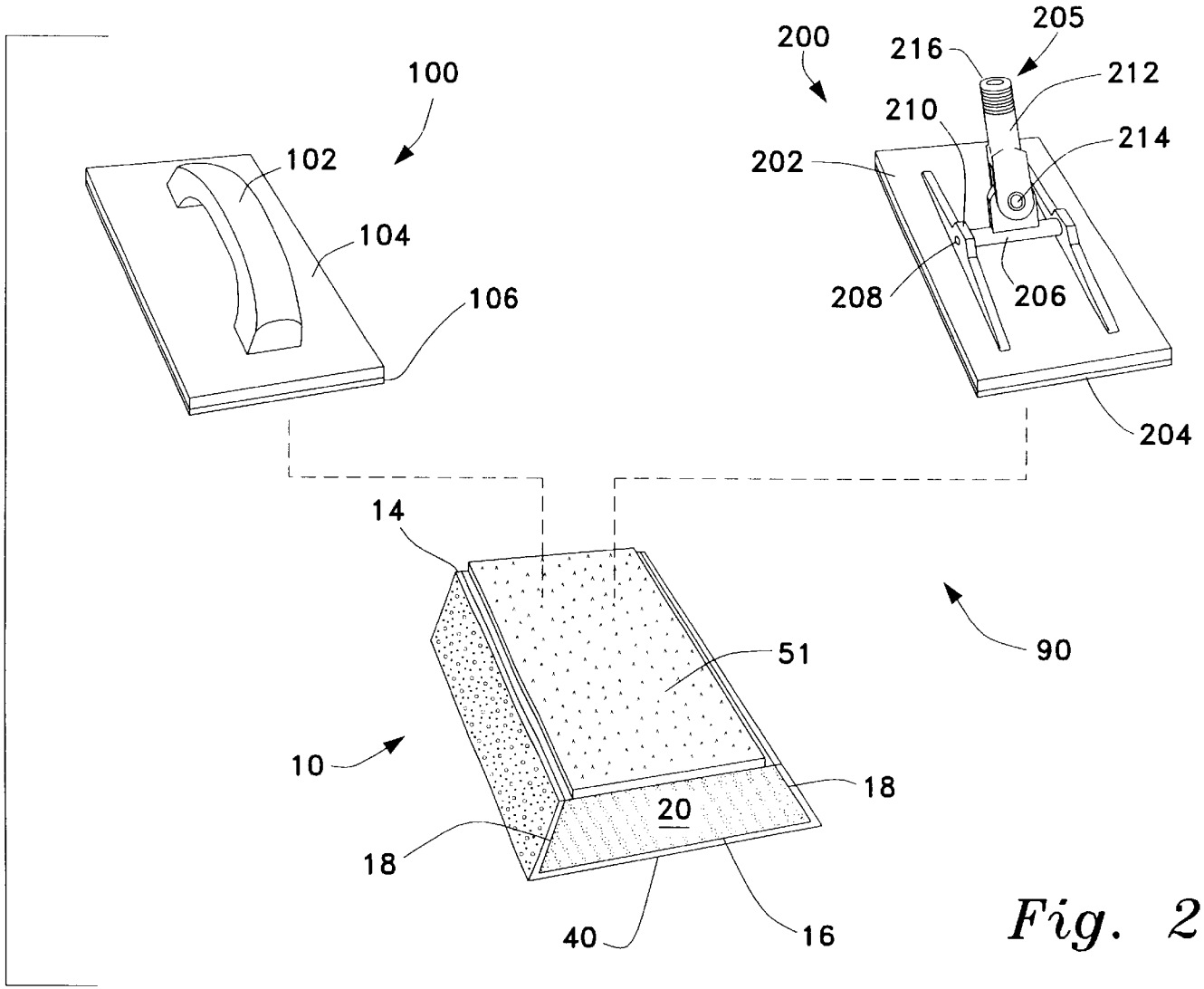
FIG. 2 is an exploded perspective view of a sanding sponge kit according to the present invention.

Alternatively, as shown in FIG. 2, the sanding sponge 10 may be sold in the form of a kit 90 which includes the sanding sponge 10, a hand sander base 100, and a pole sander head 200. The sanding sponge 10 may be releasably attached to the hand sander base 100 to reach drywall areas which are within arm's reach, and then removed from the hand sander base 100 and attached to the pole sander head 200 to reach drywall areas beyond arm's length.

Figure 3:
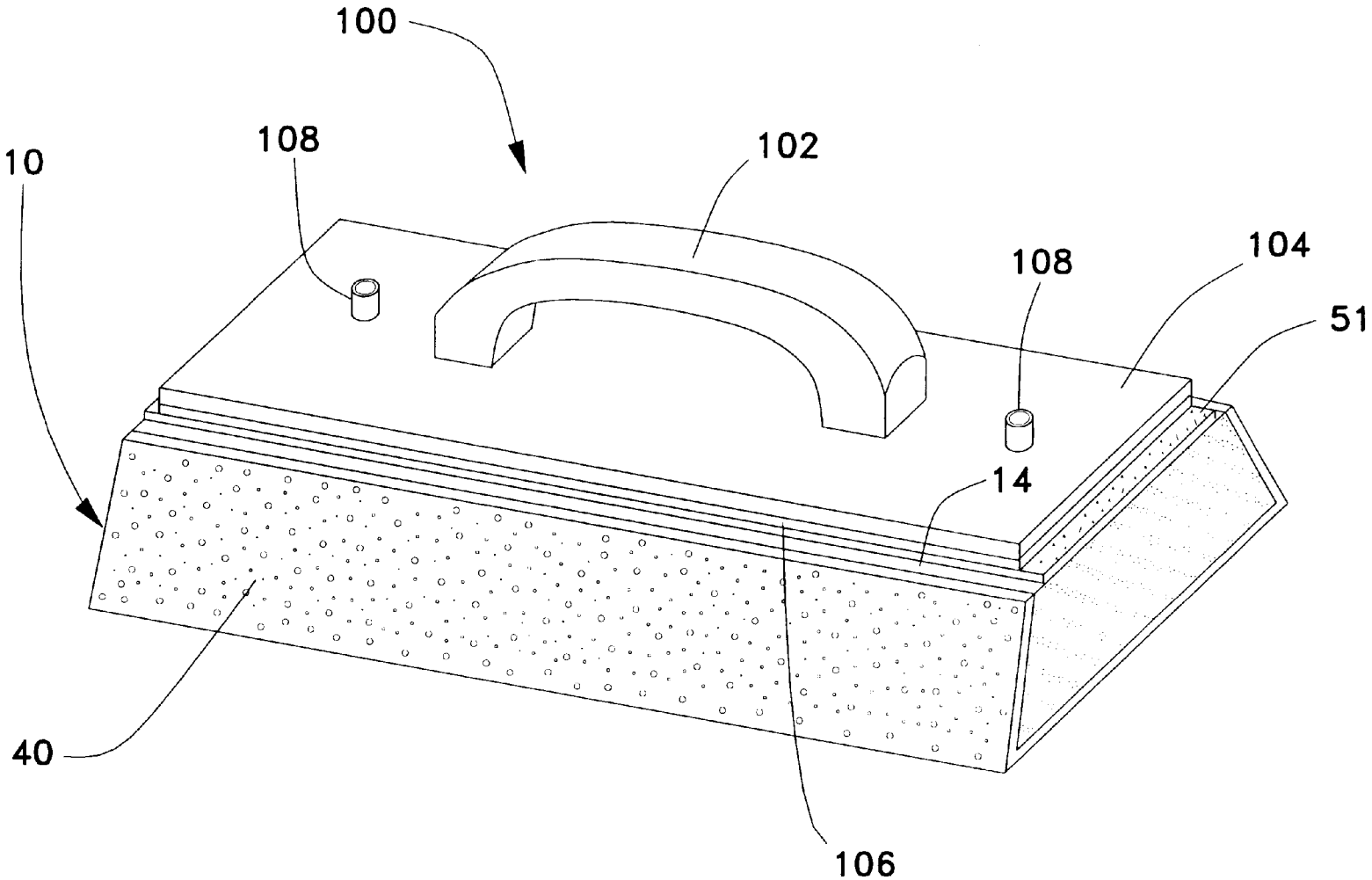
FIG. 3 is a side perspective view showing the hand sander base attached to the sanding sponge according to the present invention.

As shown in FIGS. 2 and 3, the hand sander base 100 includes a handle 102 attached to the top surface of a flat, elongated, rectangular plate 104. The base 100 has a sheet or layer of hook and loop fastening material 106 attached to the bottom surface of the plate 104, the hook and loop fastening material 106 mating with the hook and loop material 51 on the top surface 14 of the sanding # sponge 10 to temporarily fasten the sanding sponge 10 to the hand sander base 100. The handle 102 is preferably a C-shaped hand grip attached to the plate 104, but may be in the form of a knob, a rectangular block, or any other comfortable gripping surface. The plate 104 is preferably made from metal, but may be made from a rigid plastic material. A suitable hand sander base is marketed as part of a Hand Sander, Catalogue Number HS-66, available from WalBoard Tools® of Long Beach, Calif. This particular model of hand sander base has a pair of threaded bosses 108 at opposing ends of plate 104 which are used in conjunction with clamps and wing nuts or other threaded fasteners to retain sand paper or a sanding block to the bottom of the plate 104 in a conventional hand sander, but the bosses 108 are unnecessary for use in the present invention.

Figure 4:
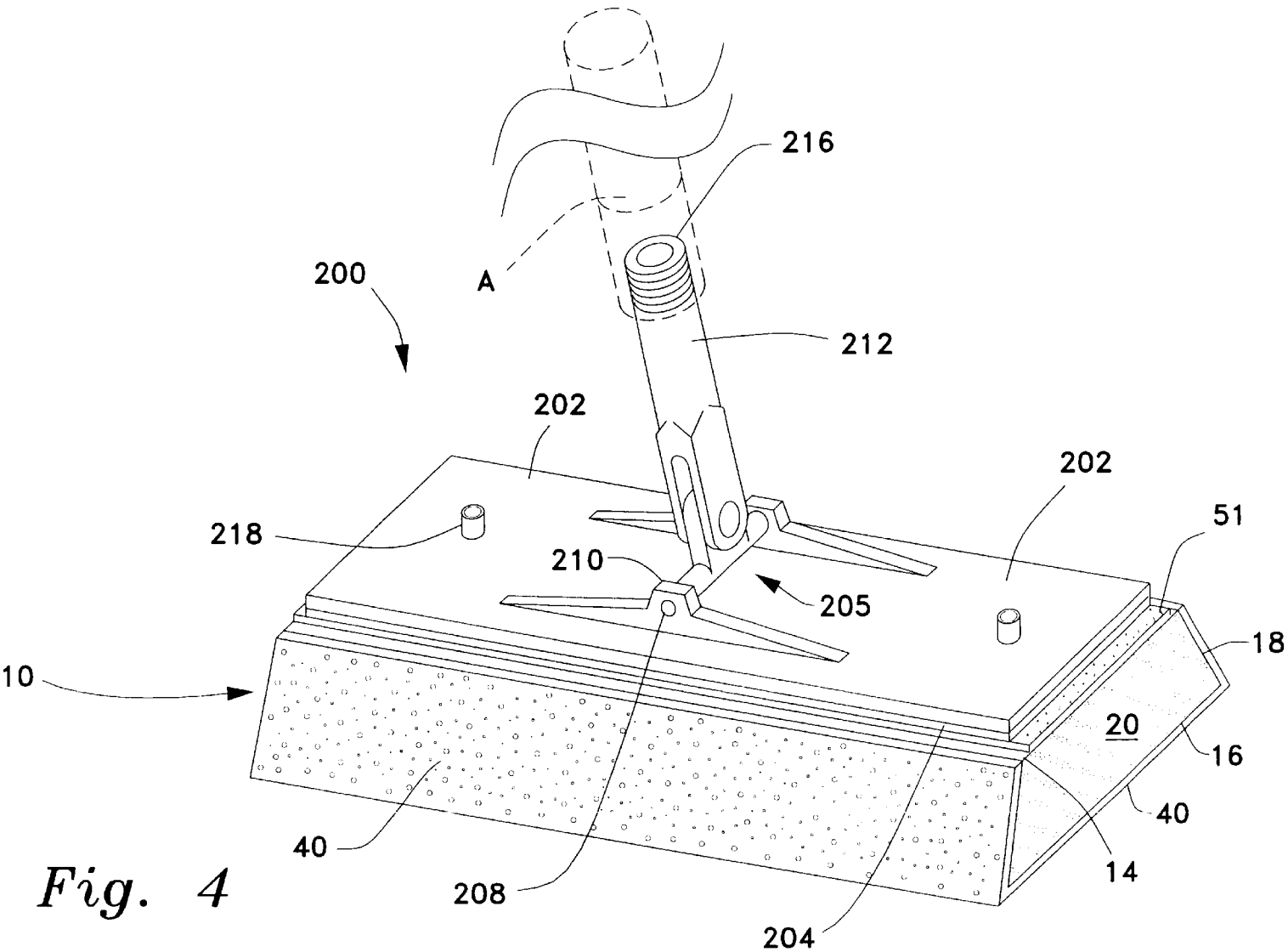
FIG. 4 shows a side perspective view showing a pole sander head attached to a sanding sponge according to the present invention.

As shown in FIGS. 2 and 4, the pole sander head 200 is a flat, elongated, rectangular plate 202. The head 200 has a sheet or layer of hook and loop fastening material 204 attached to the bottom surface of the plate 202, the hook and loop fastening material 204 mating with the hook and loop material 51 on the top surface 14 of the sanding sponge 10 to temporarily fasten the sanding sponge 10 to the pole sander head 200. The head 200 has a universal joint 205 on the top surface of the plate 202, including, a sleeve 206 rotatably mounted on a pin 208 extending between two bearings 210 for rotation parallel to the longitudinal axis of the plate 202, and a pole mounting fixture 212 pivotally mounted to the sleeve 206 for rotation transverse to the longitudinal axis of the plate 202 about pin 214. The pole mounting fixture 212 has a threaded fitting 216 for receiving an extension pole A. It will be understood, however, that the scope of the present application extends to other forms of attaching a pole to the plate 202 which permit the pole to pivot longitudinally and laterally with respect to the plate 202, e.g., a ball and socket joint, which are referred to generally as a universal joint 205 in the present application. The plate 202 is preferably a metal plate, but may be made from a rigid plastic. An example of a pole sander head which may be adapted for use with the present invention is a catalogue number AS-22 pole sander head available from WalBoard Tools® of Long Beach, Calif. This model of pole sander head has a pair of threaded bosses 218 at opposing ends of the plate 202 which are used in conjunction with clamps and wing nuts or other threaded fasteners to retain sand paper or a sanding block to the bottom of the plate 202 in a conventional pole sander, but the bosses 218 are unnecessary for use in the present invention.

Figure 5:
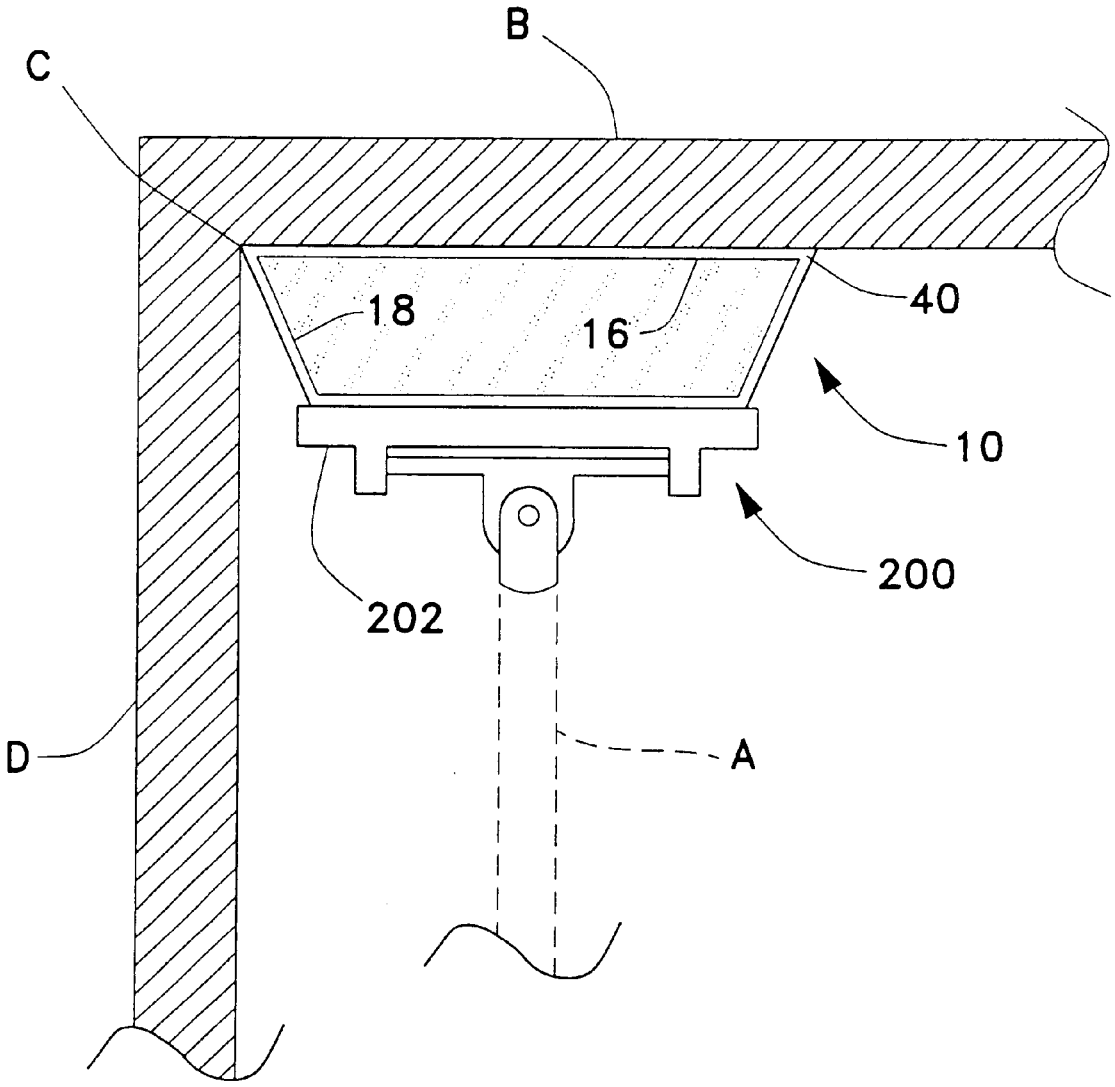
FIG. 5 is an environmental perspective view showing use of the sanding sponge attached to a pole sander for finishing a corner joint according to the present invention.

In use, the sanding sponge 10 may be affixed sequentially to the hand sander base 100 and the pole sander head 200 for smoothing drywall. The broad bottom surface 16 of the sponge 10 may be used to sand joint compound used to adhere the tape covering butt joints between coplanar sheets of drywall. FIG. 5 shows a method of using the sanding sponge 10 to feather the surface of a first wall B of an inside corner joint (FIG. 5 shows the pole sander head 200, the manner of using the hand sander base 100 being identical). It will be seen that the acute angle between the bottom surface 16 and the lateral surface 18 of the sponge 10 permit a light feathering up and down stroke on the first wall B up to the crease C between first wall B and orthogonal wall D without lateral surface 18 abrading orthogonal wall D. Also, since lateral surface 18 slopes away from the crease 18, the user does not scrape his hand against orthogonal wall D when using the hand sander 100. After sanding first wall B, the user sands orthogonal wall D. The sanding sponge 10 is usually not compressed enough to deform the sponge to sand both first wall B and orthogonal wall D simultaneously, as the drywall or tape used to cover the joints may become damaged or marred. The sanding sponge may, however, be canted enough to lightly sand the crease C with the edge formed by the junction between the lateral face 18 and the bottom face 16, the acute angle permitting sanding in the crease C without either the lateral face 18 or the bottom face 16 being flush with the first wall B or the orthogonal wall B, respectively.

It is to be understood that the sanding sponge of the present invention is not limited to the embodiments described above, but encompasses any and all embodiments within the scope of the following claims.

We claim:

1. A sanding sponge kit for sanding drywall, comprising:

a) a sanding sponge having a flexible, resilient body in the shape of a right prism having a pair of bases and wherein each of the bases is an isosceles traoezoid, the body having a top surface, a bottom surface, two lateral surfaces, and two end surfaces, each lateral surface joining the bottom surface at an acute angle, the bottom surface and the two lateral surfaces being coated by a layer of abrasive material fixedly attached thereto, the top surface having a first layer of hook and loop fastening material fixedly attached thereto;

b) a hand sander base having a plate with a top surface and a bottom surface, the base further having a handle attached to the top surface of the plate and a second layer of hook and loop fastening material fixedly attached to the bottom surface of the plate, the hand sander base being removably attachable to sad sanding sponge by mating said first and second layers of hook and loop fastening material; and c) a pole sander head having a plate with a top surface and a bottom surface, the head further having a universal joint adapted for receiving an extension pole, the universal joint being attached to the top surface of the head plate, and having a third layer of hook and to fastening material fixedly attached to the bottom surface of the head plate, the pole sander head being removably attachable to said sanding sponge by mating said first and third layers of hook and loop fastening material;

whereby said sanding sponge may be interchangeably attached to said hand sander base and said pole sander head for sanding a drywall surface.

2. The sanding sponge kit according to claim 1, wherein said sanding sponge body is made from a cellular foam material.

3. The sanding sponge kit according to claim 1, wherein the plate of said hand sander base is made from metal.

4. The sanding sponge kit according to claim 1, wherein the plate of said hand sander base is made from a rigid past material.

5. The sanding sponge kit according to claim 1, wherein the handle attached to said hand sander base plate comprises a C-shaped hand grip.

6. The sanding sponge kit according to claim 1, wherein the plate of said pole sander head is made from metal.

7. The sanding sponge kit according to claim 1, wherein the plate of said pole sander head is made from a rigid plastic material.

8. The sanding sponge kit according to claim 1, wherein said universal joint has a threaded fitting for attachment to a pole.

9. The sanding sponge kit according to claim 1, wherein the abrasive coating is an 80 grit coating for medium sanding quality.

10. The sanding sponge kit according to claim 1, wherein the abrasive coating is a 120 grit coating for fine sanding quality.

11. The sanding sponge kit according to claim 1, wherein the abrasive coating further comprises an abrasive sheet wrapped around the bottom surface and the two lateral surfaces of said sanding sponge and permanently attached thereto.

12. A sanding sponge for use wish a sanding tool, comprising a one piece body composed of a resilient flexible material, the body having the shape of a right prism having a pair of bases and wherein each of the bases is an isosceles trapezod, said body including:

(a) a top surface having a layer of hook and loop fastening material attached thereto;

(b) a bottom surface;

(c) a first side face;

(d) a second side face; and (e) said bottom surface, said first side face, and said second side face being coated by a layer of abrasive material fixedly attached thereto.

13. The sanding sponge according to claim 12, wherein said sanding sponge body is made from a cellular foam material.

14. The sanding sponge according to claim 12, wherein the layer of abrasive material is an 80 grit coating for medium sanding quality.

15. The sanding sponge according to claim 12, wherein the abrasive coating is a 120 grit coating for fine sanding quality.

16. The sanding sponge according to claim 12, wherein the abrasive coating further comprises an abrasive sheet wrapped around the bottom surface and the first and second side faces of said sanding sponge and permanently attached thereto.

* * * * *